US012570911B2

(12) United States Patent
Haara et al.

(10) Patent No.: US 12,570,911 B2
(45) Date of Patent: Mar. 10, 2026

(54) MARINE FUEL BLEND

(71) Applicant: Neste Oyj, Espoo (FI)

(72) Inventors: Riikka-Mari Haara, Porvoo (FI); Esko Karvinen, Porvoo (FI); Ulla Kiiski, Porvoo (FI); Merja Kouva, Porvoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 18/689,661

(22) PCT Filed: Sep. 6, 2022

(86) PCT No.: PCT/FI2022/050590

§ 371 (c)(1),
(2) Date: Mar. 6, 2024

(87) PCT Pub. No.: WO2023/037050

PCT Pub. Date: Mar. 16, 2023

(65) Prior Publication Data

US 2025/0122433 A1 Apr. 17, 2025

(30) Foreign Application Priority Data

Sep. 7, 2021 (FI) ..... 20215938

(51) Int. Cl.
*C10L 1/02* (2006.01)

(52) U.S. Cl.
CPC ..... *C10L 1/02* (2013.01); *C10L 2200/0484* (2013.01); *C10L 2270/026* (2013.01); *C10L 2290/24* (2013.01)

(58) Field of Classification Search
CPC ..... C10L 1/02; C10L 2200/0484; C10L 2270/026; C10L 2290/24
See application file for complete search history.

(56) References Cited

FOREIGN PATENT DOCUMENTS

| | | | | |
|---|---|---|---|---|
| CN | 111479906 | A | 7/2020 | |
| CN | 111527185 | A | 8/2020 | |
| JP | 2009-007387 | A | 1/2009 | |
| JP | 2019-0163345 | | 9/2019 | |
| WO | 2012108584 | A1 | 8/2012 | |
| WO | WO 2015/188096 | A1 | 12/2015 | |
| WO | WO 2019/129928 | A1 | 7/2019 | |
| WO | WO-2020109653 | A1 * | 6/2020 | ..... C10G 3/47 |

OTHER PUBLICATIONS

Muhammad Ahmar Zuber et al., "Performance of Sludge Palm Oil Combustion Using Waste Oil Burner", Journal of Advanced Research in Fluid Mechanics and Thermal Sciences 49, Issue 1, (2018), pp. 55-61.

Einemo, "VLSFO: Fact Versus Fiction", Ship & Bunker—News and intelligence for the marine fuels industry, Mar. 18, 2021, 8 pages.

(Continued)

*Primary Examiner* — Taiwo Oladapo
(74) *Attorney, Agent, or Firm* — Joshua B. Brady; Nixon & Vanderhye, P.C.

(57) ABSTRACT

The present invention relates to a marine fuel blend having a kinematic viscosity of 2-30 $mm^2/s$ as measured at 50° C. according to EN ISO 3104:2020 and comprising 0.5-50 vol-% of palm oil effluent sludge bottom.

13 Claims, 1 Drawing Sheet

(56) References Cited

OTHER PUBLICATIONS

Foretich et al., "Challenges and opportunities for alternative fuels in the maritime sector", In: Maritime Transport Research, https://doi.org/10.1016/j.martra.2021.100033, vol. 2, Aug. 2, 2021, 27 pages.
Iso, "Air Pollution Prevention", Review of 2020 marine fuels quality, Marine Environment Protection Committee, 76th session, Agenda item 5, Jan. 29, 2021, 4 pages.
Lin, "Effects of Biodiesel Blend on Marine Fuel Characteristics for Marine Vessels", In: Energies 2013, vol. 6, <doi:10.3390/en6094945>, Sep. 24, 2013, pp. 4945-4955.
International Search Report for PCT/FI2022/050590 mailed Oct. 18, 2022, 3 pages.
International Preliminary Report on Patentability for PCT/FI2022/050590 completed May 8, 2023, 7 pages.
Finland Search Report for FI20215938 dated Nov. 30, 2021, 2 pages.
Written Opinion of the International Search Authority for PCT/FI2022/050590 mailed Oct. 18, 2022, 4 pages.
Chinese Office Action in CN Application No. 202280059949.1 issued Dec. 4, 2025.

* cited by examiner

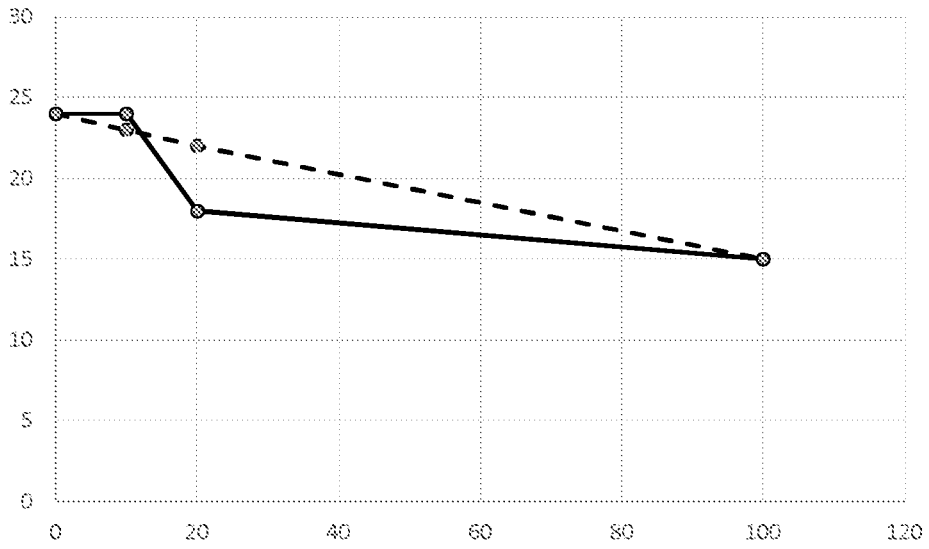
30
25
20
15
10
5
0
0
20
40
60
80
100
120

MARINE FUEL BLEND

CROSS-REFERENCE TO RELATED APPLICATIONS

This application is the U.S. national phase of International Application No. PCT/FI2022/050590 filed Sep. 6, 2022 which designated the U.S. and claims priority to FI 20215938 filed Sep. 7, 2021, the entire contents of each of which are hereby incorporated by reference.

FIELD

The present invention relates to a marine fuel blend as well as use of a marine fuel blend.

BACKGROUND AND OBJECTS

Marine fuels are traditionally based on fossil oil and are usually of higher viscosity than for example gasoline and diesel used for land vehicles. However, due to the problems related to pollution and climate change, there exists a need to also provide marine fuels having a lower sulphur content, for example. Another need is to reduce the emission of greenhouse gas (GHG) emissions. It is indeed an aim of the International Maritime Organisation IMO to reduce the total annual GHG emissions from international shipping by at least 50% by 2050, compared to the level of 2008. This target may be achieved by improving for example efficiency of motors and operations, but also alternative fuels are needed.

Palm oil sludge, also called palm oil mill effluent oil (POME oil) or palm oil effluent sludge (PES), is a slurry that is a side-product in the production of palm oil. It is today considered as a waste product of low value but when it is treated further, other end uses can be found to the treated products, thus increasing their value.

One of the treatments of PES is distillation, typically preceded by one or more purification treatments. The maximum distillation temperature is typically 260° C. when the aim is to remove free fatty acids. Such distillation naturally also leads to removal of volatile organic compounds. The distillation typically takes place under pressure (such as 3-5 mbar (absolute pressure)). Steam stripping is often used for enhancing the removal of the free fatty acids. The resulting products include palm oil effluent sludge bottom, which is thus a distilled bottom fraction from PES crude oil straight distillation. It may also be called refined palm oil mill effluent (refined POME). The distillation removes the free fatty acids of the product, resulting in lower total acid number (TAN).

Document WO 2012/108584 discloses a method of manufacturing an environment-friendly biobunker C oil having low sulphur content. The method uses a process where palm fruits are first treated with temperature, then pressed and refined, yielding a palm raw oil. This palm raw oil is further refined, yielding a refined, bleached and deodorised palm oil, as well as a palm oil by-product. This liquid palm oil by-product is then filtered and completely dissolved by adding an organic solvent. Thereafter water is removed from the dissolved palm oil by-product by bringing a water removing agent in contact with the dissolved palm oil by-product; impurities are removed from the water-removed palm oil by-product by centrifuging, and the organic solvent is removed, thereby completing manufacture of a refined palm oil by-product. Finally, the refined palm oil by-product and bunker C oil are mixed, thereby completing manufacture of a biobunker C oil.

It is an aim to provide a use for the palm oil effluent sludge bottom. Another aim is to provide an alternative marine fuel and marine fuel blend. A still further aim is to provide a marine fuel blend that has less fossil-based components than traditional marine fuels, i.e., to provide a marine fuel blend having a renewable component therein.

SUMMARY OF THE INVENTION

The invention is defined by the features of the independent claims. Some specific embodiments are defined in the dependent claims. According to one aspect, there is provided a marine fuel blend having a kinematic viscosity of 2-30 $mm^2/s$ as measured at 50° C. according to EN ISO 3104:2020 and comprising 0.5-50 vol-% of palm oil effluent sludge bottom, the marine fuel blend fulfilling at least one of the categories of ISO 8217:2017 (E) for marine fuels. According to another aspect, there is provided use of a marine fuel blend for reducing the greenhouse gas emissions. For the blending component depending of the volume-% of the component, reduction of GHG emissions is at least 9% as $CO_{2eq}$/MJ calculated according to the directive 2018/2001 of the European Parliament and of the Council. According to a further aspect, there is provided a method for manufacturing a marine fuel blend having a kinematic viscosity of 2-30 $mm^2/s$ as measured at 50° C. according to EN ISO 3104:2020 comprising mixing a fossil-based component with 0.5-50 vol-% of palm oil effluent sludge bottom, the resulting marine fuel blend fulfilling at least one of the categories of ISO 8217:2017 (E) for marine fuels.

BRIEF DESCRIPTION OF THE DRAWING

FIG. 1 illustrates measured pour point versus calculated pour point for some blends according to an embodiment.

DETAILED DESCRIPTION

In the present description, weight percentages (wt-%) are calculated on the total weight of the blend. Volume percentages (vol-%) are also calculated on the total volume of the blend.

The term "renewable" in the context of a renewable fuel component refers to one or more organic compounds derived from any renewable source (i.e., not from any fossil-based source). Thus, the renewable fuel component is based on renewable sources and consequently does not originate from or is derived from any fossil-based material. Such component is characterised by mandatorily having a higher content of 14C isotopes than similar components derived from fossil sources. Said higher content of 14C isotopes is an inherent feature characterizing the renewable fuel component and distinguishing it from fossil fuels. Thus, in fuel blends, wherein a portion of the blends is based on partly fossil based material and partly renewable fuel component, the renewable component can be determined by measuring the $^{14}C$ activity. Analysis of $^{14}C$ (also referred to as carbon dating or radiocarbon analysis) is an established approach to determine the age of artefacts based on the rate of decay of the isotope $^{14}C$, as compared to $^{12}C$. This method may be used to determine the physical percentage fraction of renewable materials in bio/fossil mixtures as renewable material is far less aged than fossil material and so the types of material contain very different ratios of $^{14}C$:$^{12}C$. Thus, a particular ratio of said isotopes can be used as a "tag" to identify a renewable carbon compound and differentiate it from non-renewable carbon compounds. While the renewable component reflects the modern atmospheric $^{14}C$ activity, very little $^{14}C$ is present in fossil fuels (oil, coal). Therefore, the renewable fraction of any material of interest is proportional to its $^{14}C$ content. Samples of fuel blends may be analysed post-reaction to determine the amount of renewable sourced carbon in the fuel. This approach would work equally for co-processed fuels or fuels produced from mixed feedstocks. It is to be noted that there is not necessarily any need to test input materials when using this approach as renewability of the fuel blend may be directly measured. The isotope ratio does not change during chemical reactions. Therefore, the isotope ratio can be used for identifying renewable isomeric paraffin compositions, renewable hydrocarbons, renewable monomers, renewable polymers, and materials and products derived from said polymers, and distinguishing them from non-renewable materials. Feedstock of raw material of biological origin means material having only renewable (i.e., contemporary or biobased or biogenic) carbon, $^{14}C$, content which may be determined using radiocarbon analysis by the isotopic distribution involving $^{14}C$, $^{13}C$ and/or $^{12}C$ as described in ASTM D6866 (2018). Other examples of a suitable method for analysing the content of carbon from biological or renewable sources are DIN 51637 (2014) or EN 16640 (2017).

For the purpose of the present invention, a carbon-containing material, such as a feedstock or product is considered to be of biological i.e., renewable origin if it contains 90% or more modern carbon (pMC), such as 100% modern carbon, as measured using ASTM D6866.

In the present description, by "category of ISO 8217:2017 (E) for marine fuels" is meant the various categories (such as DMX, DMA, DFA, DMZ, RMA, RMG, RMD, RMG etc.) listed in Tables 1 and 2 of the standard, as "category ISO-F-". A marine fuel blend fulfilling at least one of the categories of ISO 8217:2017 (E) for marine fuels is thus a marine fuel blend which fulfils all the requirements of a single category, such as RMG, i.e. that can be used in applications where a marine fuel classified as RMG is required.

According to an aspect of the present invention, there is provided a marine fuel blend having a kinematic viscosity of 2-30 $mm^2/s$ as measured at 50° C. according to EN ISO 3104:2020 and comprising 0.5-50 vol-% of palm oil effluent sludge bottom, the marine fuel blend fulfilling at least one of the categories of ISO 8217:2017 (E) for marine fuels.

The marine fuel blend thus comprises a certain amount of palm oil effluent sludge bottom, also called PES bottom in this description. The marine fuel blend also fulfils at least one of the categories of ISO 8217:2017 (E) for marine fuels, the standard listing several different marine fuel categories. The present marine fuel blend thus allows providing a decarbonised marine fuel blend to meet the stricter environmental requirements. It also provides a marine fuel blend that comprises components that are not usable for food industry, or are not used as such for road or aviation fuels. The renewable component used in the present marine fuel blend is scalable and economical.

The present marine fuel blend uses a PES bottom that is liquid in the blending or mixing temperature. Indeed, there is no need to dissolve the PES bottom, and hence no need to use a solvent specifically for the PES bottom, as heating is sufficient to render it to a stage where it can be mixed with the other components. The process and resulting marine fuel blend is thus free from solvent, i.e. solvent is absent.

The PES bottom used in the present marine fuel blend is preferably manufactured as follows. A product from palm oil mill, namely crude palm oil mill effluent (POME) oil is first pre-treated, i.e. purified by settling, degumming and bleaching or any combination of these. This pre-treatment reduces the amount of water, insoluble and soluble impurities in the material. Thereafter, the pre-treated material is distilled and free fatty acids separated from the POME oil. The PES bottom used in the present marine fuel blend is obtained as the bottom fraction of this distillation step, having cut point of maximum 260° C. An especially advantageous property of the present marine fuel blend is that for certain mixtures, it has a pour point that is better (i.e. lower) than the expected calculated value.

The "crude POME" used for making the present PES bottom is thus a different effluent stream obtained earlier in the palm oil mill process than the "palm raw oil" stream used in WO 2012/108584 mentioned above (after further refining and separation of the feeds to refined palm oil and palm oil by-product). The present "PES bottom" is therefore a different by-product of the palm oil mill process, than the "palm oil by-product" used in WO 2012/108584.

The kinematic viscosity of the marine fuel blend is 2-30 $mm^2/s$, preferably 5-15 $mm^2/s$ as measured at 50° C. according to EN ISO 3104:2020. The kinematic viscosity may be for example from 2, 3, 4, 5, 7, 10, 12, 13, 15, 18, 20, 22 or 25 $mm^2/s$ up to 5, 7, 10, 12, 13, 15, 18, 20, 22, 25, 27 or 30 $mm^2/s$, as measured at 50° C. according to EN ISO 3104: 2020.

According to an embodiment, the marine fuel blend has a pour point of at most 30° C. as measured by ASTM D5950-14 (2020). The pour point may indeed also be below 0° C., and the upper limit of 30° C. fulfils the requirement for marine fuels. According to a preferred embodiment, the pour point is 15-30° C., or more preferably, 20-30° C. as measured by ASTM D5950-14 (2020). The pour point may thus be for example from 1, 5, 10, 15 or 20° C. up to 5, 10, 15, 20, 25 or 30° C. as measured by ASTM D5950-14 (2020). As mentioned above, for some combinations of components, the pour point is lower than its calculated value, as will be demonstrated below in the Experimental part.

According to another embodiment, the marine fuel blend has an amount of aged sediment of less than 0.05 wt-%, as measured by ISO 10307-2:2009. This amount fulfils the requirements of max 0.1 wt-% that is mentioned in the standard for marine fuels. The amount of aged sediment may even be less than 0.04, 0.03, 0.02 or 0.01 wt-% or even lower.

The marine fuel blend may also have an ash content of less than 0.04 wt-%, as measured by ISO 6245:2002. This ash content fulfils the requirements of the standard for marine fuels. The ash content may even be less than 0.03, 0.02 or 0.01 wt-%.

The sulphur content of the marine fuel blend is preferably at most 0.1 wt-%, as measured by ISO 8754:2003. This sulphur content fulfils the requirements for Sulphur Emission Control Area (SECA area). The sulphur content may even be less than 0.09, 0.08, 0.07, 0.06, 0.05, 0.04 or 0.03, wt-%, or even lower.

The present marine fuel blend comprises 0.5-50 vol-% of palm oil effluent sludge bottom, preferably 10-30 vol-% of palm oil effluent sludge bottom. The amount of PES bottom in the blend may thus be from 0.5, 1, 3, 5, 7, 10, 12, 15, 18, 20, 25, 30, 35 or 40 vol-% up to 1, 3, 5, 7, 10, 12, 15, 18, 20, 25, 30, 35, 40, 45 or 50 vol-%, calculated from the total volume of the marine fuel blend. In some embodiments, the amount of PES bottom in the blend is from 12 vol-% up to 50 vol-%, or from 18 vol-% up to 46 vol-%.

The marine fuel blend may comprise other fuel components of renewable origin. For example, it may comprise fatty acid methyl ester (FAME). FAME is a type of fatty acid ester that is derived by transesterification of fats with methanol, usually obtained from vegetable oils by transesterification. The amount of FAME may be at most 10 vol-%. For example, the amount of FAME may be at most 9, 8, 7, 6, 5, 4, 3, 2 or 1 vol-%, based on the total volume of the marine fuel blend.

The fossil part of the marine fuel blend may comprise distillate marine fuel or fuels, residual marine fuel or fuels or mixtures thereof. For example, the marine fuel blend may comprise 10 wo-% of residual marine fuel, up to 50 vol-% of PES bottom, the rest being distillate marine fuel.

The composition of the marine fuel blend may also be for example 90 vol-% of residual marine fuel and 10 vol-% of PES bottom. Alternatively, the composition may be 80 vol-% of residual marine fuel and 20 vol-% of PES bottom, or 83 vol-% of residual marine fuel, 10 vol-% of PES bottom and 7 vol-% of FAME.

The marine fuel blend may also comprise co-processed components, i.e. components where an oil of fossil origin has been co-processed with a feed of renewable origin in a conventional fossil fuel processing system.

The present marine fuel blend may comprise any known marine fuel or mixtures thereof. For example, it may comprise marine fuels as defined by their properties in ISO 8217:2017 (E), i.e. DMX, DMA, DFA, DMZ, DFZ, DMB, DFB, RMA, RMB, RMD, RME, RMG or RMK, such as RMG180, RMG380, RMG500 or RMG700 or RMK380, RMK500 or RMK700.

For example, the marine fuel may be RMG, which is a residual fuel, which comprises hydrocracked residual oil, LCO (Light Cycle Oil, a diesel boiling range product, from fluid catalytic cracking units) and/or hydrocracked distillates. The fuel typically has a 50° C. kinematic viscosity maximum of 700 $mm^2/s$ and density of maximum 991 $kg/m^3$. The content of hydrocracked residual oil is typically in the range of 0-70 wt-%. The hydrocracked residual oil may also comprise from 0-100 wt-% hydrocracked deasphalted oil. According to another example, the marine fuel may be RMB, which is also a residual fuel, and may comprise distilled gas oil containing (hydrocracked) vacuum distillates. It typically has a kinematic viscosity of 30 cSt at 50° C., a density of max 960 $kg/m^3$, a pour point of 30° C. or less and a boiling range of C6-C43.

According to another aspect, there is provided use of a marine fuel blend for reducing the greenhouse gas emissions at least 9% as $CO_{2eq}$/MJ calculated according to the directive 2018/2001 of the European Parliament and of the Council, of 11 Dec. 2018 on the promotion of the use of energy from renewable sources. The reduction of at least 9% of the GHG emissions is for a blend comprising 10 vol-% of palm oil effluent sludge bottom. When 20 vol % of this bottom is used, the GHG emissions are reduced by 18%, and when 50 vol-% of the bottom is used, the reduction of GHG emissions is 45% $CO_{2eq}$/MJ calculated according to the EU-directive 2018/2001. The use of the present marine fuel blend thus allows to reduce the GHG emissions, as it comprises renewable material. The present marine fuel blend thus fulfils at least partly the requirements of IMO, with respect to reductions of greenhouse gas emissions, as discussed above.

According to yet another aspect, there is provided a method for manufacturing a marine fuel blend having a kinematic viscosity of 2-30 $mm^2/s$ as measured at 50° C. according to EN ISO 3104:2020, comprising mixing a fossil-based component with 0.5-50 vol-% of palm oil effluent sludge bottom, the resulting marine fuel blend fulfilling at least one of the categories of ISO 8217:2017 (E) for marine fuels. The palm oil effluent sludge bottom is as described above.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Furthermore, the described features, structures, or characteristics may be combined in any suitable manner in one or more embodiments. In the description, numerous specific details are provided to provide a thorough understanding of embodiments of the invention.

The verbs "to comprise" and "to include" are used in this document as open limitations that neither exclude nor require the existence of also un-recited features. The features recited in dependent claims are mutually freely combinable unless otherwise explicitly stated. Furthermore, it is to be understood that the use of "a" or "an", i.e. a singular form, throughout this document does not exclude a plurality.

EXPERIMENTAL PART

The present marine fuel blend was tested with different compositions and the properties of the resulting blends were tested. The test results are given below in Tables 1 and 2.

The RMB used in the fuel blend consisted of heavy distillates and based on the viscosity it meets the residual marine grade specification ISO 8217:2020 (E) standard.

The PES bottom used was straight distilled bottom fraction from crude PES having cut point max 260° C.

The FAME used fulfilled EN 14214:2012+A2:2019 standard.

The measurement methods were as follows:

Density at 15° C.:ISO 12185:1996

Pour point: ASTM D5950-14 (2020)

Kinematic viscosity, at 50° C.:EN ISO 3104:2020, B method

Sulphur content of the marine fuel blend and RMB:ISO 8754:2003

Sulphur content of FAME: Analysis is based on XRF technique.

Sulphur content of the PES bottom: ASTMD 7039-15 (2013)

Flash point: ISO 2719:2016, A method.

Flash point of FAME: ASTMD 7236-16a (2016)

Ash content: ISO 6245:2002

Carbon residue: ISO 10370:2014

Total acid number (TAN) of the marine fuel blend and RMB:ISO 6619:1988

Total acid number (TAN) of the PES bottom and FAME: ISO 660:2020

Total sediment content: ISO 10307-1:2009

Total aged sediment content: ISO 10307-2A: 2009

Additionally, Table 1 gives the calculated carbon aromaticity index (CCAI), calculated using the following equation:

$$CCAI = D - 140.7 \log(\log(V + 0.85)) - 80.6 - 483.5 \log\left(\frac{t + 273}{323}\right)$$

wherein

D=density at 15° C. (kg/m$^3$)

V=kinematic viscosity (mm$^2$/s)

t=viscosity temperature (° C.)

In Table 1, the column titled ISO 8217 lists the requirements of said standard (ISO 8217:2017 (E)) for marine fuels, with the exception of the pour point, where the maximum is indicated as 30.0° C. (and marked with *). This maximum limit of 30.0° C. for the pour point is the requirement for certain R-grade marine fuels.

Table 2 shows the measured pour point versus the calculated pour point (as the arithmetic mean). It can thus be seen that at least for the combination of 80 vol-% of RMB with 20 vol-% of PES bottom has a pour point that is 4° C. lower than the calculated value. The same is illustrated in FIG. 1.

In FIG. 1, the PES content in vol-% is given on the abscissa, and the pour point in ° C. on the ordinate. The hatched line illustrates the calculated values while the solid line gives the results of the measurement, i.e. the measured pour point.

TABLE 1

| Property | Unit | ISO 8217: 2017 (E) | RMB | PES bottom | FAME | RMB + 10 vol-% PES bottom | RMB + 20 vol-% PES bottom | RMB + 7 vol-% FAME + 10 vol-% PES bottom |
|---|---|---|---|---|---|---|---|---|
| Density | kg/m$^3$ | max 960.0 | 870.4 | — | 882.7 | 875.2 | 880.2 | 875.8 |
| Pour point | ° C. | max 30.0 (*) | 24 | 15 | 3 | 24 | 18 | 21 |
| Viscosity at 50° C. | mm$^2$/s | max 30.00 | 8.437 | — | — | 10.1 | 11.95 | 9.249 |
| Sulphur | wt-% | max 0.10 | 0.07 | 0.01 | 0.001 | 0.06 | 0.05 | 0.05 |
| Flash point | ° C. | min 60.0 | 114 | — | >120.0 | 118.0 | 120.0 | 116.5 |
| Ash | wt-% | max 0.070 | <0.001 | — | — | 0.014 | 0.025 | 0.013 |
| Carbon residue | wt-% | max 10.00 | <0.1 | — | — | 0.36 | 0.59 | 0.33 |
| TAN | mg KOH/g | max 2.5 | <0.10 | 5.0 | 0.5 | 0.7 | 1.3 | 0.7 |
| CCAI | | max 860 | 791 | — | — | 792 | 793 | 795 |
| Total sediment | wt-% | — | — | 0.03 | <0.01 | — | — | <0.01 |
| Total sediment - Aged | wt-% | max 0.10 | <0.01 | | | 0.01 | <0.01 | <0.01 |

TABLE 2

| Pour point | RMB | FAME | PES bottom | RMB + 10 vol-% PES bottom | RMB + 20 vol-% PES bottom | RMB + 7 vol-% FAME + 10 vol-% PES bottom |
|---|---|---|---|---|---|---|
| Measured value [° C.] | 24 | 3 | 15 | 24 | 18 | 21 |
| Calculated value [° C.] | — | — | — | 23 | 22 | 22 |
| Improvement Δ [° C.] | — | — | — | −1 | 4 | 1 |

Based on the experiments when PES bottom is used either 10 vol-% or 20 vol-% together with RMB, the produced blend fulfils the requirements of marine fuel standard except for the strictest limits for the pour point. Further, a better pour point value has been measured than expected for a blend having 20 vol-% of PES bottom and 80 vol-% of RMB. The lower than expected pour point allows the product to be handled in colder conditions, which reduces energy consumption for heating, for example.

The invention claimed is:

1. A marine fuel blend having a kinematic viscosity of 2-30 $mm^2/s$ as measured at 50° C. according to EN ISO 3104:2020 and comprising:

0.5-50 vol-% of palm oil effluent sludge bottom from PES crude oil distillation, and a fossil-based component and/or components where an oil of fossil origin has been co-processed with a feed of renewable origin, the marine fuel blend fulfilling at least one of the categories of ISO 8217:2017(E) for marine fuels.

2. The marine fuel blend according to claim 1, wherein the kinematic viscosity is 5-15 $mm^2/s$ as measured at 50° C. according to EN ISO 3104:2020.

3. The marine fuel blend according to claim 1, having a pour point of at most 30° C. as measured by ASTM D5950-14(2020).

4. The marine fuel blend according to claim 3, having a pour point of 15-30° C. as measured by ASTM D5950-14 (2020).

5. The marine fuel blend according to claim 4, having a pour point of 20-30° C. as measured by ASTM D5950-14 (2020).

6. The marine fuel blend according to claim 1, having an amount of aged sediment of less than 0.05 wt-%, as measured by ISO 10307-2:2009.

7. The marine fuel blend according to claim 1, having an ash content of less than 0.04 wt-%, as measured by ISO 6245:2002.

8. The marine fuel blend according to claim 1, having a sulphur content of at most 0.1 wt-%, as measured by ISO 8754:2003.

9. The marine fuel blend according to claim 1, comprising 10-30 vol-% of palm oil effluent sludge bottom.

10. The marine fuel blend according to claim 1, further comprising fatty acid methyl ester.

11. The marine fuel blend according to claim 10, wherein the amount of fatty acid methyl ester is at most 10 vol-%.

12. The marine fuel blend according to claim 1, comprising distillate marine fuel, residual marine fuel or mixtures thereof.

13. A method for manufacturing a marine fuel blend having a kinematic viscosity of 2-30 $mm^2/s$ as measured at 50° C. according to EN ISO 3104:2020 comprising mixing a fossil-based component and/or components where an oil of fossil origin has been co-processed with a feed of renewable origin, with 0.5-50 vol-% of palm oil effluent sludge bottom from PES crude oil distillation, the resulting marine fuel blend fulfilling at least one of the categories of ISO 8217:2017(E) for marine fuels.

* * * * *